US009675182B2

(12) United States Patent
Longenecker

(10) Patent No.: US 9,675,182 B2
(45) Date of Patent: Jun. 13, 2017

(54) BI-AXIALLY COLLAPSIBLE FRAME FOR A BASSINET

(71) Applicant: ARTSANA USA, INC., Lancaster, PA (US)

(72) Inventor: Michael L. Longenecker, Lancaster, PA (US)

(73) Assignee: ARTSANA USA, INC., Lancaster, PA (US)

( * ) Notice: Subject to any disclaimer, the term of this patent is extended or adjusted under 35 U.S.C. 154(b) by 0 days.

(21) Appl. No.: 14/686,707

(22) Filed: Apr. 14, 2015

(65) Prior Publication Data

US 2015/0216322 A1 Aug. 6, 2015

Related U.S. Application Data

(63) Continuation-in-part of application No. 13/958,728, filed on Aug. 5, 2013, now Pat. No. 9,066,607.

(51) Int. Cl.

| | |
|---|---|
| ***A47D 13/06*** | (2006.01) |
| ***A47D 9/00*** | (2006.01) |
| ***A47D 7/04*** | (2006.01) |

(52) U.S. Cl.

CPC ..... *A47D 9/005* (2013.01); *A47D 7/04* (2013.01)

(58) Field of Classification Search

CPC .... A47D 13/063; A47D 13/06; A47D 13/061; A47D 13/066; A47D 7/00; A47D 7/002; A47D 7/04; A47C 17/68

See application file for complete search history.

(56) References Cited

U.S. PATENT DOCUMENTS

| | | | | | |
|---|---|---|---|---|---|
| 240,903 | A * | 5/1881 | Glenn | A47C 19/122 | 5/110 |
| 351,074 | A * | 10/1886 | Seymour | A47C 17/66 | 5/110 |
| 715,346 | A * | 12/1902 | Brubaker | A47C 3/029 | 297/131 |
| 795,618 | A * | 7/1905 | James | A47C 17/66 | 5/110 |
| 1,300,621 | A * | 4/1919 | Key | A47C 17/68 | 16/350 |
| 1,434,100 | A * | 10/1922 | Creasy | A47C 17/78 | 5/111 |

(Continued)

*Primary Examiner* — Peter M Cuomo
*Assistant Examiner* — Ifeolu Adeboyejo
(74) *Attorney, Agent, or Firm* — Patent Law Associates

(57) ABSTRACT

A foldable frame comprises opposing pairs of side and end frame members joined at respective ends to define a generally rectangular and planar frame perimeter. The end members and the side members are generally movable between folded and unfolded positions. The end members are spaced-apart along a longitudinal axis of the frame. The side frame members extend generally parallel to the longitudinal axis to define a frame length. Pivoting connections enable the end members and the side frame members to pivot, each member having a pivot connection at each end thereof. Pivoting of a respective end or side member is permitted when the frame is configured to align the respective end pivots, but is inhibited when the frame is configured to move the respective end pivots out of alignment. The respective pivot axes of the end and side members are generally perpendicular oriented and define a folding and unfolding sequence.

11 Claims, 14 Drawing Sheets

(56) References Cited

U.S. PATENT DOCUMENTS 1,856,624 A * 5/1932 Davis ..... A47C 17/68 5/114
2,128,018 A * 8/1938 Skidmore ..... A47C 19/126 5/114
2,194,320 A * 3/1940 Pearson ..... A47C 7/002 5/99.1
2,203,193 A * 6/1940 Ettinger ..... A47C 19/126 5/111
2,430,714 A * 11/1947 Geer ..... A62B 1/22 160/351
2,574,610 A * 11/1951 Aarestad ..... A47D 7/002 280/42
2,976,545 A * 3/1961 Vanderminden ..... A47C 17/68 5/111
3,225,364 A * 12/1965 Miret ..... A47D 11/005 5/93.1
3,232,502 A * 2/1966 Kleinbortas ..... B60R 9/045 224/314
3,789,439 A * 2/1974 Berg ..... A47D 13/063 5/93.2
3,886,609 A * 6/1975 MacKenzie ..... A47C 17/82 5/110
3,967,330 A * 7/1976 Zawadowsky ..... A47C 19/122 5/111
4,663,787 A * 5/1987 Kolsch ..... A47C 1/14 5/110
4,685,161 A * 8/1987 Zalman ..... A47C 19/126 403/55
4,692,953 A * 9/1987 Fetters ..... A47D 9/005 5/99.1
4,819,285 A * 4/1989 Fetters ..... A47D 13/063 5/99.1
5,269,587 A * 12/1993 Cunningham ..... A47D 1/02 297/16.1
5,349,709 A * 9/1994 Cheng ..... A47D 7/03 5/93.1
5,363,521 A * 11/1994 Garland ..... A47D 13/063 5/98.1
5,449,014 A * 9/1995 Yan-ho ..... A47C 29/003 135/156
5,539,957 A * 7/1996 Schmidt ..... A63B 63/004 16/254
5,544,864 A * 8/1996 Gabriel-Lacki ..... A47D 7/002 256/25
5,617,594 A * 4/1997 Chien ..... A47D 1/02 5/101
5,727,265 A * 3/1998 Ziegler ..... A47D 13/063 5/93.1
5,918,329 A * 7/1999 Huang ..... A47D 5/00 5/503.1
5,956,786 A * 9/1999 Huang ..... A47D 9/02 403/329
6,014,781 A * 1/2000 Cone, II ..... A47D 7/002 403/99
6,125,483 A * 10/2000 Stroud ..... A47D 13/063 135/128
6,263,525 B1 * 7/2001 Liu ..... A47D 13/063 5/98.1
6,386,986 B1 * 5/2002 Sonner ..... A47D 13/105 297/273
6,526,608 B1 3/2003 Hsia
6,543,070 B2 4/2003 Longenecker et al.
6,701,547 B2 3/2004 Hsia
7,065,805 B1 * 6/2006 Sundberg ..... A47K 3/127 297/256.12
7,263,729 B2 9/2007 Paesang et al.
7,614,098 B1 * 11/2009 Quarry ..... A47C 7/407 24/13
7,908,686 B2 3/2011 Clapper et al.
9,179,786 B1 * 11/2015 Ransil ..... A47D 9/005
2007/0011809 A1 * 1/2007 Chen ..... A47D 13/063 5/99.1
2008/0000023 A1 * 1/2008 Chen ..... A47D 13/063 5/99.1
2010/0017959 A1 * 1/2010 Yoshe ..... A47C 17/82 5/99.1
2012/0037869 A1 2/2012 Fiore, III et al.
2012/0096646 A1 * 4/2012 Barron ..... A47D 9/005 5/655
2012/0204347 A1 * 8/2012 Li ..... A47D 5/006 5/93.1
2012/0233770 A1 9/2012 Greger et al.
2012/0235103 A1 9/2012 Greger et al.
2014/0047639 A1 * 2/2014 Cheng ..... A47D 13/063 5/99.1
2014/0075670 A1 * 3/2014 Crumrine ..... A23C 9/1542 5/99.1
2014/0283298 A1 * 9/2014 Cheng ..... A47D 9/005 5/111
2015/0059089 A1 * 3/2015 Falkiner ..... B60N 2/2854 5/110
2015/0216322 A1 * 8/2015 Longenecker ..... A47D 7/04 5/99.1

* cited by examiner

BI-AXIALLY COLLAPSIBLE FRAME FOR A BASSINET

CROSS-REFERENCE TO RELATED APPLICATIONS

This application is a continuation in part of application Ser. No. 13/958,728 filed on Aug. 5, 2013 and issued as U.S. Pat. No. 9,066,607 on Jun. 30, 2015.

BACKGROUND OF THE INVENTION

This invention relates generally to portable enclosures for infants, and more particularly to a leg-supported foldable frame for a bassinet that may be collapsed into a comparatively compact space when not in use.

Portable playards are useful to contain and provide a safe environment for small children to sleep or play. Playards generally include side walls and a bottom floor made of fabric material or similar soft goods supported on a collapsible frame that allows the playard to be easily stored or transported.

As playards have become more popular with consumers, numerous related accessories have been developed to expand the capability and versatility of the playard. Bassinets, changing tables and the like may be selectively attached to the playard frame to provide an elevated surface for supporting infants in a more readily accessible position that eliminates the need for caregivers to bend over to access an infant on the playard floor. The increased availability of playard accessories has created a growing demand for certain accessories designed for stand-alone use separate from the playard. The portable bassinet, while always offered in the market, is one such product experience a resurgence in demand.

Portability of infant care accessories is an increasingly important consideration among consumers. While collapsible frames are well-known in the art, frames that are easily reconfigured or collapsed into a compact package continue to push manufactures for innovation. Awkwardly reconfigurable frames or latching mechanism and frames requiring significant space when folded do not meet consumer demands. Consequently, the need to improve portability, compactness, and ease of use of collapsible frames is a growing concern. Many benefits would be realized by a stand-alone folding bassinet frame that is conveniently collapsible into a compact form and is highly resistant to inadvertent collapse when deployed.

SUMMARY OF THE INVENTION

Accordingly, the present invention, in any of the embodiments described herein, may provide one or more of the following advantages:

It is an object of the present invention to provide a foldable frame for supporting a free-standing bassinet for an infant. The frame comprises a plurality of upstanding frame members defining the corners of the playard. A plurality of horizontal frame members individually span between adjacent upstanding frame members to define a top perimeter frame which includes a pair of generally opposing, parallel, and spaced-apart side frame members and a pair of generally opposing end members interconnecting the side frame members. A plurality of generally planar wall panels span between adjacent upstanding frame members to define the side walls of the playard. The foldable frame comprises a pair of upper frame rails, a lower frame rail, and a pair of end members which join the upper and lower frame rails to form a frame. The end members are spaced-apart to define a longitudinal axis of the frame. The upper and lower frame rails extend generally parallel to the longitudinal axis to define a frame length and pivotally connected at each end to the end members to enable pivoting of the frame rails about transverse axes generally perpendicular to the longitudinal axis. The upper frame rails have a fixed length between the pivoting connections. The lower frame rails incorporate telescoping sections enabling the length between the pivoting connections to be varied. The ability to shorten the lower frame rails length allows the end members to pivot inwardly toward the upper frame rails and the lower frame rails are moved toward the upper frame rails.

It is another object of the present invention to provide a foldable frame that is foldable about at least two axes wherein a first is generally transverse to the longitudinal axis of the frame and a second is generally parallel to the longitudinal axis. The foldable frame comprises a pair of side frame members and a pair of end members which are joined at respective ends to define a frame perimeter, generally rectangular and planar. The end members are spaced-apart along a longitudinal axis of the frame. The side frame members extend generally parallel to the longitudinal axis to define a frame length. Pivoting connections enable the end members and the side frame members to pivot, each member having a pivot connection at each end thereof. Pivoting of a respective end or side member is permitted when the frame is configured to align the respective end pivots, but is inhibited when the frame is configured to move the respective end pivots out of alignment. The respective pivot axes of the end and side members are generally perpendicular oriented and define a folding and unfolding sequence.

It is a still further object of the present invention to provide a foldable frame capable of collapsing by folding about at least two axes, a first being generally transverse to the length of the frame and a second being generally parallel to the length of the accessory frame. Movement about the first axis aligns pivots of the second axis to allow the pivoting about the second axis in a first pivotal position and inhibit pivoting about the second axis when not in the first pivotal position.

It is a still further object of the present invention to provide a foldable frame capable of collapsing by folding about at least two axes that is durable in construction, inexpensive of manufacture, carefree of maintenance, easily assembled, and simple and effective to use.

These and other objects are achieved in accordance with the present invention by providing a foldable frame comprises a pair of side frame members and a pair of end members which are joined at respective ends to define a frame perimeter, generally rectangular and planar. The end members and the side members are generally movable between folded and unfolded positions. The end members are spaced-apart along a longitudinal axis of the frame. The side frame members extend generally parallel to the longitudinal axis to define a frame length. Pivoting connections enable the end members and the side frame members to pivot, each member having a pivot connection at each end thereof. Pivoting of a respective end or side member is permitted when the frame is configured to align the respective end pivots, but is inhibited when the frame is configured to move the respective end pivots out of alignment. The respective pivot axes of the end and side members are generally perpendicular oriented and define a folding and unfolding sequence.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined as the playard would normally rest on the floor or a similarly level surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
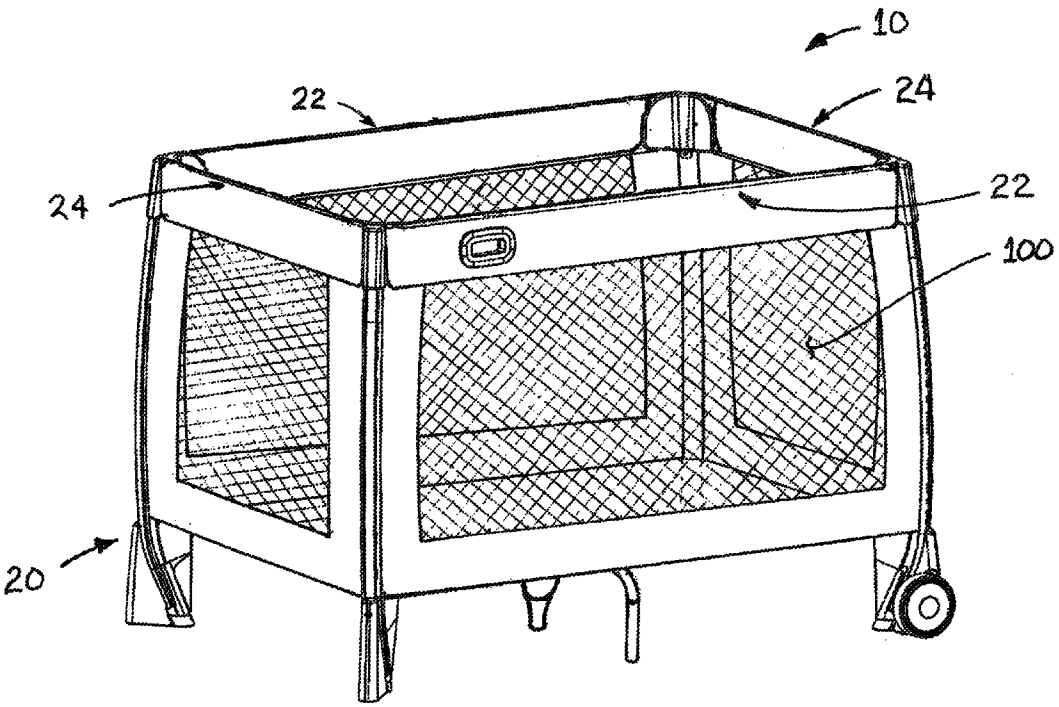
FIG. 1 is a perspective view of a conventional playard on which the present invention is useful.

Referring to the figures, an exemplary playard 10 on which the principles of the present invention are beneficial is shown in FIG. 1 comprising an upstanding frame structure 20 covered by a fabric body 100 defining side walls and a floor to contain a small child while leaving the area within the upper perimeter of the frame open. The frame structure 20 includes a pair of generally opposing and spaced-apart upper side rails 22 and a pair of generally opposing upper end rails 24 disposed between the opposing side rail members to form a generally rectangular upper perimeter of the playard frame structure 20. It is well known, though not shown in detail, to include movable joints and folding connections in the frame structure 20 that allow the playard to be collapsed for portability. Portable playards in the style of the exemplar presented are well known in the art and not discussed in further detail herein. Numerous playard accessories to enhance convenience for the caregiver are configured for attachment adjacent the upper perimeter frame.

Referring to FIGS. 2 through 7, a first embodiment of a foldable accessory frame 30 for selective attachment to the exemplar playard is illustrated in an unfolded or deployed position as it would be configured for use on a playard. The accessory frame 30 may find utility in a variety of playard accessories. The exemplar accessory frame 30 shown herein is a configuration commonly referred to as a changing table which provides an elevated level surface encircled by an upstanding wall to provide a convenient area for attending to an infant. For purposes of clarity, the accessory frame 30 is shown with soft goods removed to better illustrate the relationship and degrees of motion of the frame members and related components.

The foldable accessory frame 30 comprises elongate first and second upper frame rails 32, 33 extending generally parallel to and spaced apart from a longitudinal axis 200 of the accessory frame. The ends of the upper frame rails 32, 33 are connected to first and second end members 35, 36 in a manner that allows pivotal movement therebetween about first and second upper pivot axes 201, 202 that are aligned transversely to longitudinal axis 200. The first and second upper frame rails 32, 33 and first and second ends 35, 36 are configured to define an upper perimeter of the accessory frame 30, preferably generally rectangular, with the frame members and end members defining the length, width, and a plane of the upper frame. It is preferable for the length and width dimensions to be fixed when the accessory frame is deployed for use.

The foldable frame 30 further comprises first and second lower frame rails 37, 38 which extend longitudinally generally parallel to the upper frame rails 32, 33. The lower frame rails 37, 38 are vertically spaced below the upper frame rails to define a frame depth and a lower perimeter which allows upstanding side walls to be formed by soft good panels spanning between the respective lower and upper frame perimeters. First and second lower frame rails 37, 38 are pivotally connected to the first and second end members 35, 36 by pivot connectors 359, 369 along first and second lower pivotal axes 205, 206 aligned parallel to and positioned below first and second upper pivot axes 201, 202, respectively.

Figure 3:
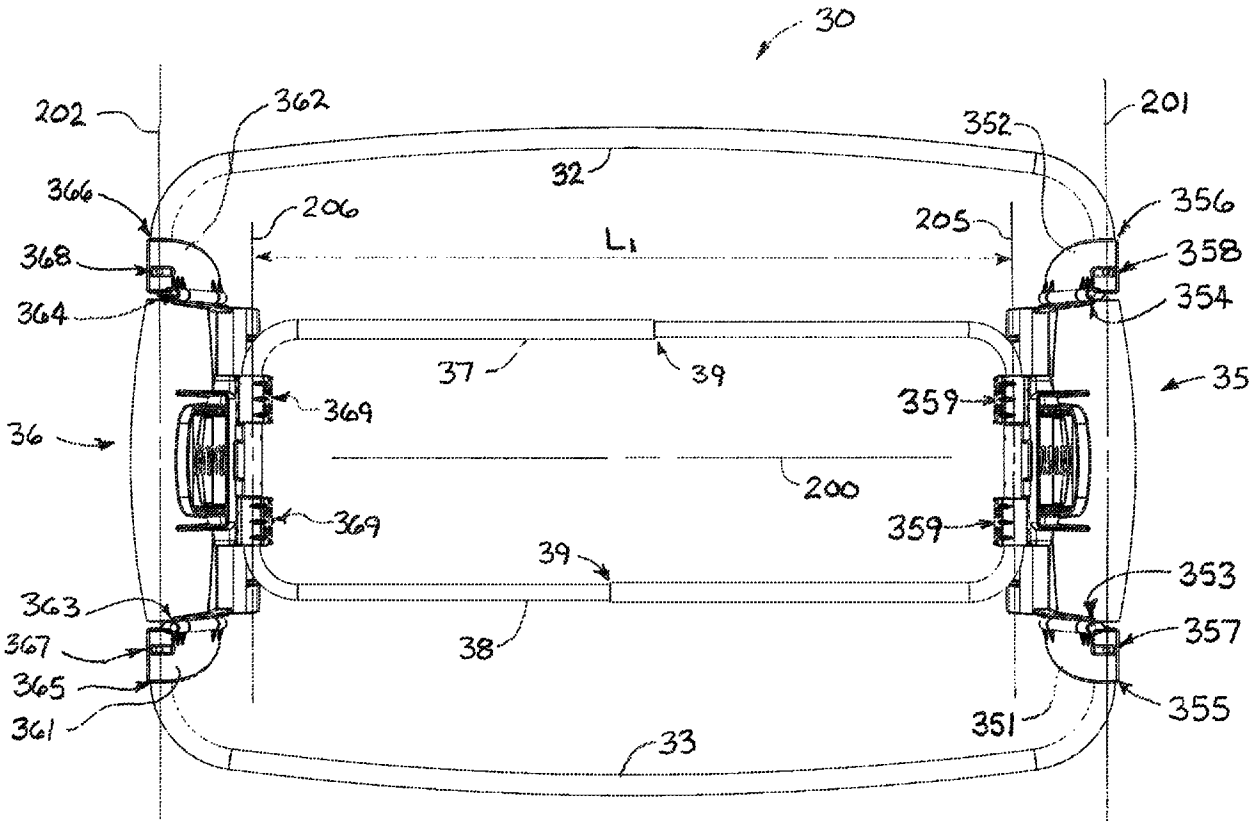
FIG. 3 is a plan view of an accessory frame of FIG. 2.
Figure 4:
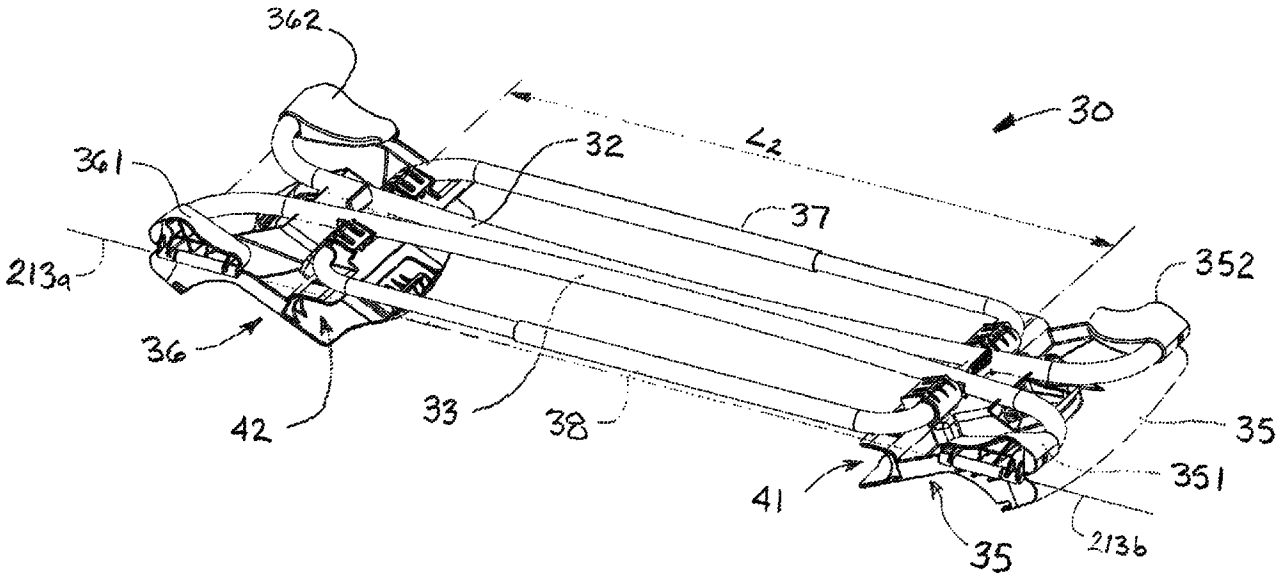
FIG. 4 is a perspective view of the accessory frame of FIG. 2 shown in a collapsed position as it would be for stowage.
Figure 5:
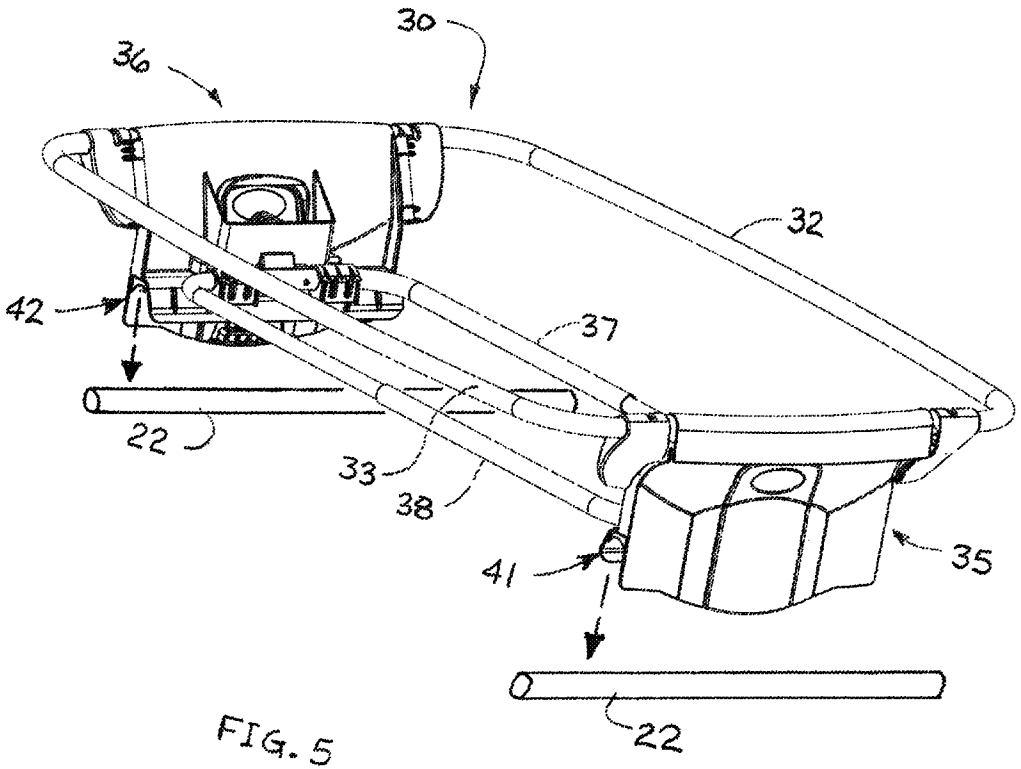
FIG. 5 is a perspective view of the accessory frame of FIG. 2 showing the connection to the playard upper frame members.
Figure 6:
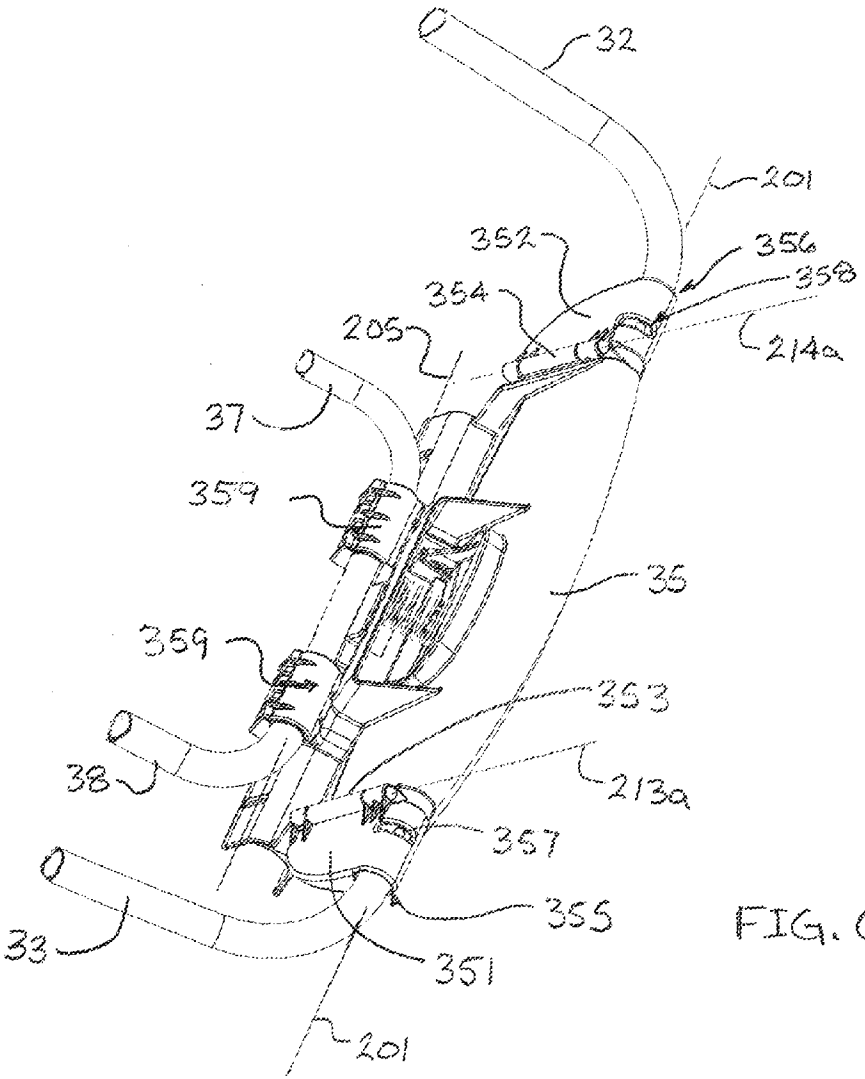
FIG. 6 is an expanded view on one end of the accessory frame of FIG. 2.
Figure 7:
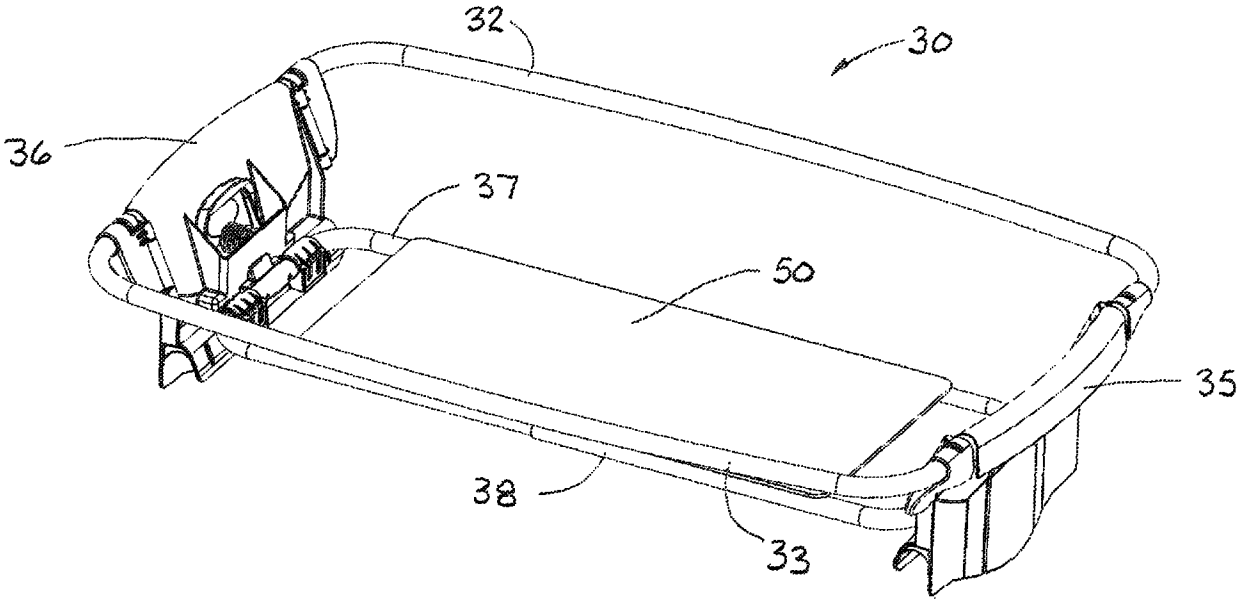
FIG. 7 is a perspective view of the accessory frame in the deployed position showing inclusion of a floor support panel.

First and second upper frame rails 32, 33 are preferably fixed in length. First and second lower frame rails 37, 38 each include telescoping joints 39 that allow the length of the lower frame rails to be varied. The variable length of the lower frame rails allows the first and second ends 35, 36 to be pivoted about first and second upper pivot axes 201, 202 so that the lower pivot connectors 359, 369 are moved inwardly toward the center of the frame and upwardly toward the plane of the upper frame perimeter. In so doing, the vertical height (depth) of the frame (separation between the upper and lower frame rails) is reduced and the lower frame rails 37, 38 are repositioned more closely to the plane of the upper frame rails as shown in FIG. 4. The accessory frame 30 is shown in a deployed position in FIG. 3 and the length of the lower frame rails is indicated as $L_1$. As shown in FIG. 4, the collapsed accessory frame 30 is accomplished by shortening the length of the lower frame rails 37, 38 to a collapsed length of $L_2$ which is less than $L_1$. Detents in the pivoting connections or latches may be provided to maintain the accessory frame 30 in the deployed position and prevent unintended collapse of the frame during use.

In one embodiment, the accessory frame 30 further comprises a support panel 50 disposed upwardly adjacent to the lower frame rails 37, 38 to provide a stable bottom or floor for the accessory frame. The support panel may be easily removable for stowage or, by limiting the length of the support panel to a length less than the collapsed length $L_2$ of the lower frame rails 37, 38, the support panel may remain in position as the accessory frame is collapsed.

The accessory frame 30 is further configured for placement atop the upper side rails 22 of the playard frame. One or more saddle-like receiver structures 41, 42 are provided on the lower edges of each of the first and second ends 35, 36 and aligned to engage the playard upper side rails when the foldable frame is operably installed atop the playard. The receiver structures 41, 42 are configured so that once the changing table is lowered onto the playard frame and the receiver structures 41, 42 engage the upper perimeter frame rails 22, the accessory frame is laterally restrained from movement in relation to the playard. See FIG. 5. Additional details on the connection apparatus for the accessory frame are disclosed in U.S. Pat. No. 8,544,125 to Greger, the entirety of which is incorporated herein by reference.

Figure 2:
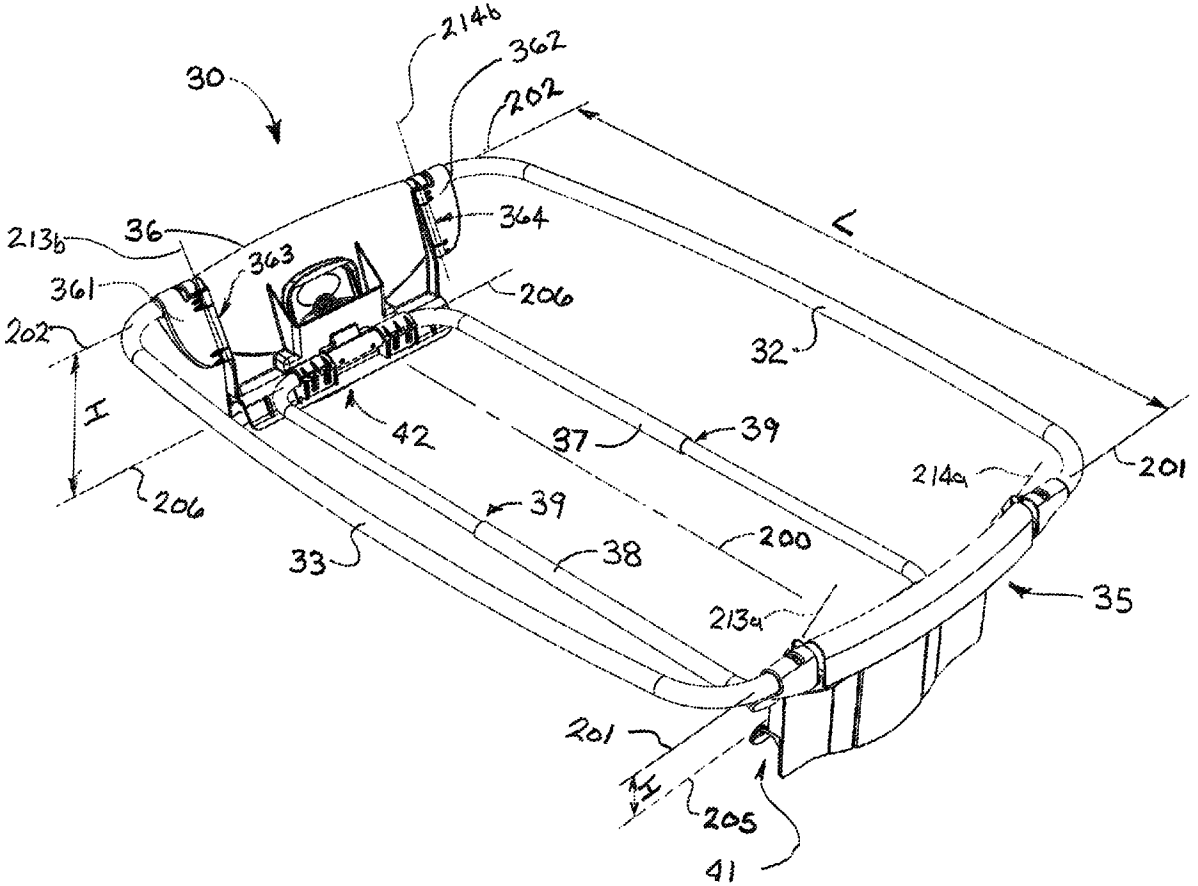
FIG. 2 is a perspective view of a foldable accessory frame shown deployed for use in which the soft goods have been removed embodying aspects of the present invention and useful with the playard of FIG. 1.

In addition to having a collapsible height as described above, the accessory frame 30 also includes features to allow the width of the frame to be reduced for stowage or convenience. First and second ends 35, 36 feature additional hinged connections 353, 354, 363, 364 for the upper frame rails which allow the upper frame rails to be folded inwardly toward the longitudinal centerline of the accessory frame once the initial pivoting of the end members to the stowed position (shown in FIG. 4) has occurred. To this end, first end member 35 further includes outboard wing members 351 and 352 which are pivotally connected to the end member 35 by wing hinges 353, 354 pivoting about wing pivot axes 213*a*, 214*a*, respectively. The outboard wing members 351, 352 incorporate the pivoting connections 355, 356 for upper frame rails 32, 33 allowing pivoting about first upper pivot axis 201. Second end member 36 is similarly configured comprising outboard wing members 361 and 362 which are pivotally connected to the end member 36 by pivoting connections 365, 366 at wing pivot axes 213*b*, 214*b*, respectively. Movement about the wing pivot axes 213, 214 is on the order of 180 degrees between the deployed position and the folded position. When the accessory frame is deployed for use, as shown in FIGS. 2 and 3, the opposing wing axis pairs 213*a*, 213*b* and 214*a*, 214*b* are skewed relative to the longitudinal centerline 200, and non-co-axially aligned which prevents folding of the wing members 351, 352, 361, 362. As the accessory frame is folded toward the stowed position, the opposing wing axis pairs align so that wing axis 213*a* is co-axially aligned with wing axis 213*b*, wing axis 213*b* is co-axially aligned with wing axis 214*b*, and all of the wing axes are parallel to the longitudinal axis 200. Once the wing axis pairs are aligned, the upper frame rails 32, 33 may be folded inwardly toward the accessory frame centerline as shown in FIG. 4 thereby reducing the width of the accessory frame for stowage. It is only when the respective wing axes are aligned that folding of the upper frame wings is possible thereby precluding unintentional collapse of the upper frame rails when the accessory frame is in a deployed position.

Outboard wing member pivoting connections 355, 356, 365, 366 further incorporate pivot limiters 357, 358, 367, 368, respectively, which limit the degree of upper frame rail 32, 33 motion, preferably to approximately 90 degrees corresponding to the necessary pivoting movement of the end members 35, 36 about pivot axes 201, 202. The pivot limiters 357, 358, 367, 368 further assure that the end members 35, 36 may not be pivoted when the end members are in the collapsed position (FIG. 4). By preventing end member pivoting when the wing members are folded inwardly, the mechanism establishes a sequence for collapsing and deploying the accessory frame and inhibits unintentional collapsing and deploying of the frame. Locking provisions such as detents or snap locks may also be incorporated to retain the pivoting connections 355, 356, 365, 366 in preferred positions corresponding to the collapsed and deployed positions to further in inhibit unintentional movement of the accessory frame whether collapsed for stowage or deployed for use.

Figure 8:
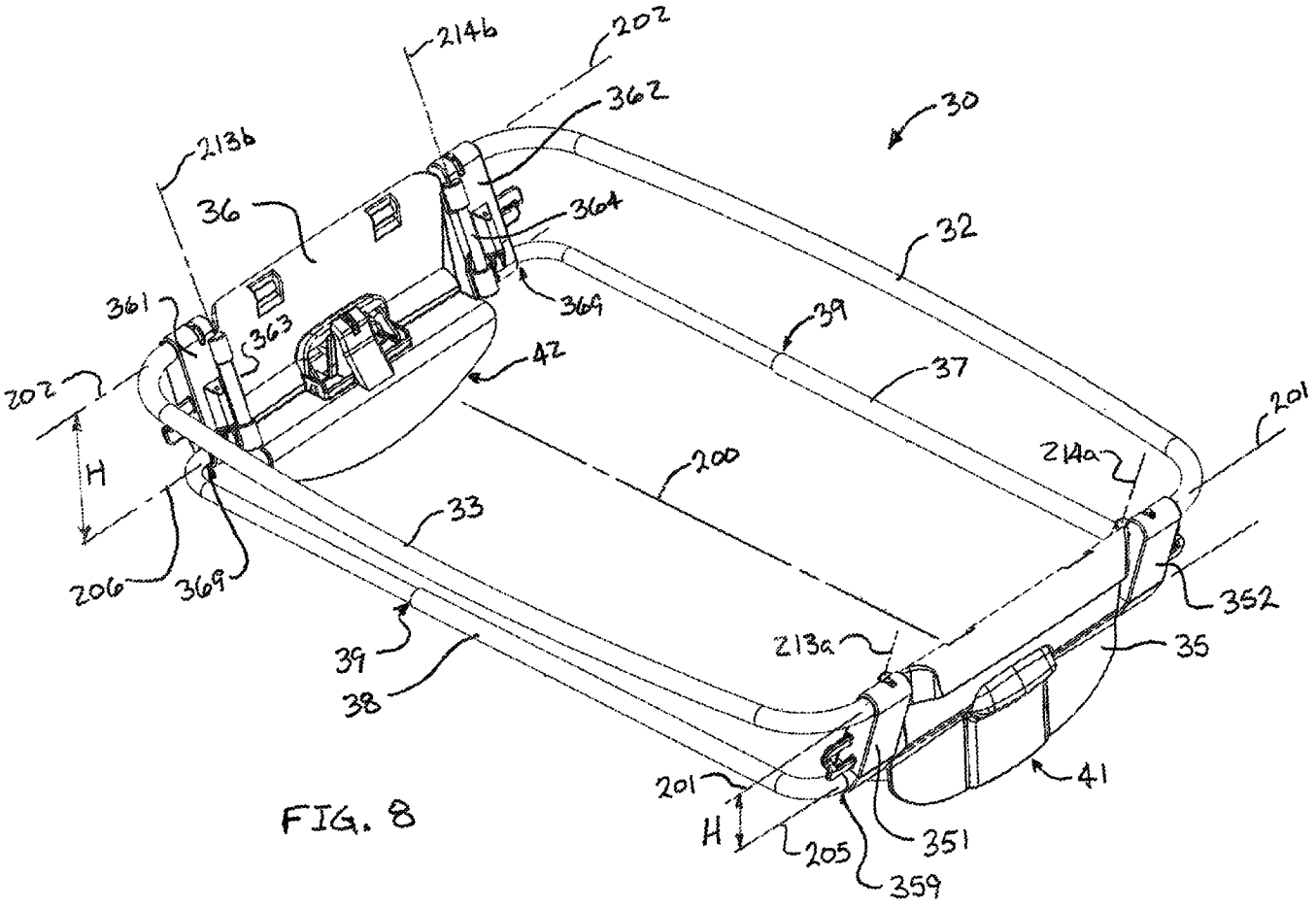
FIG. 8 is a perspective view of a second embodiment of the accessory frame shown in the deployed position.
Figure 9:
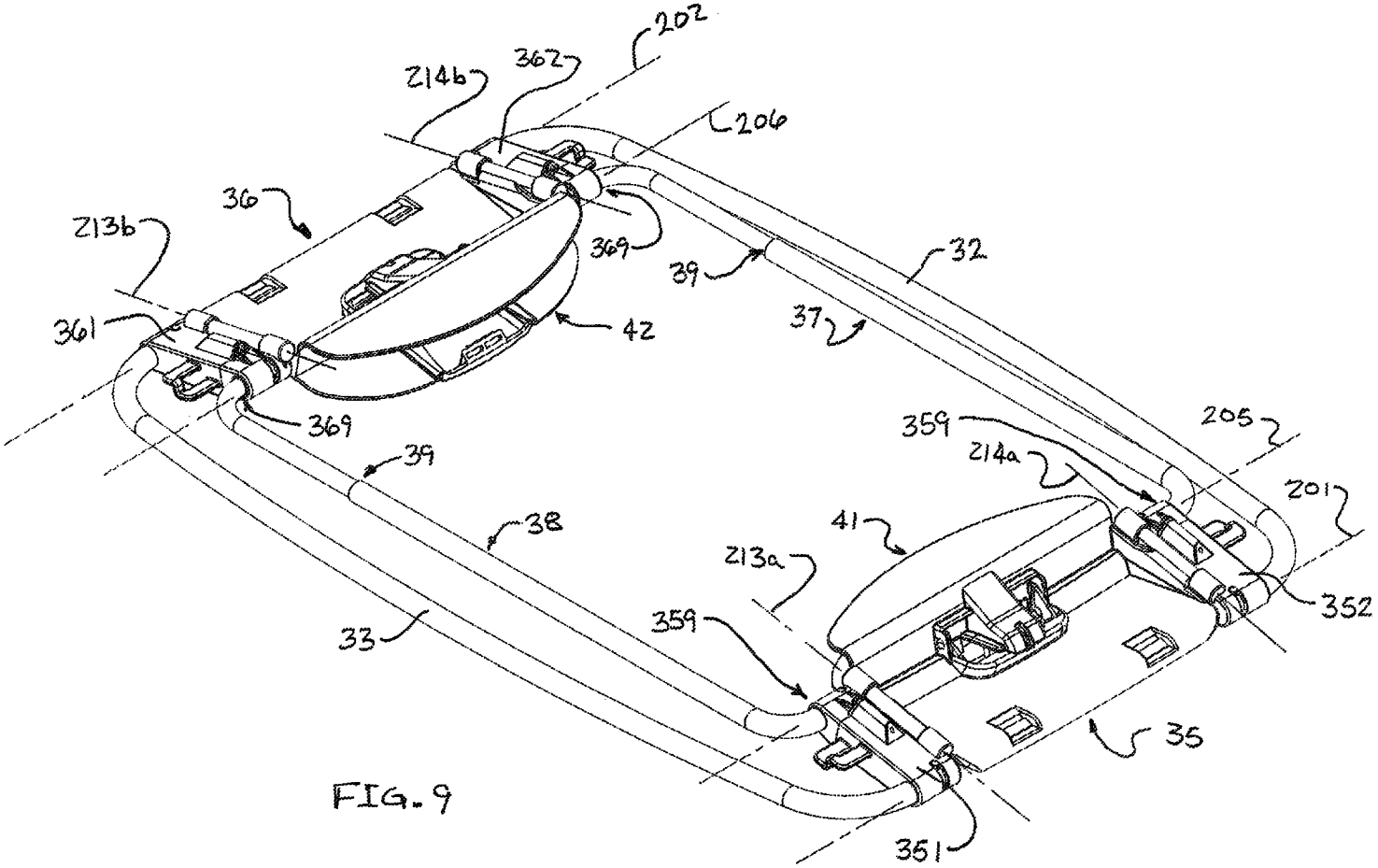
FIG. 9 is a perspective view of the accessory frame of FIG. 8 in which the end members have been pivoted to allow the frame to be vertically collapsed to its minimum height.
Figure 10:
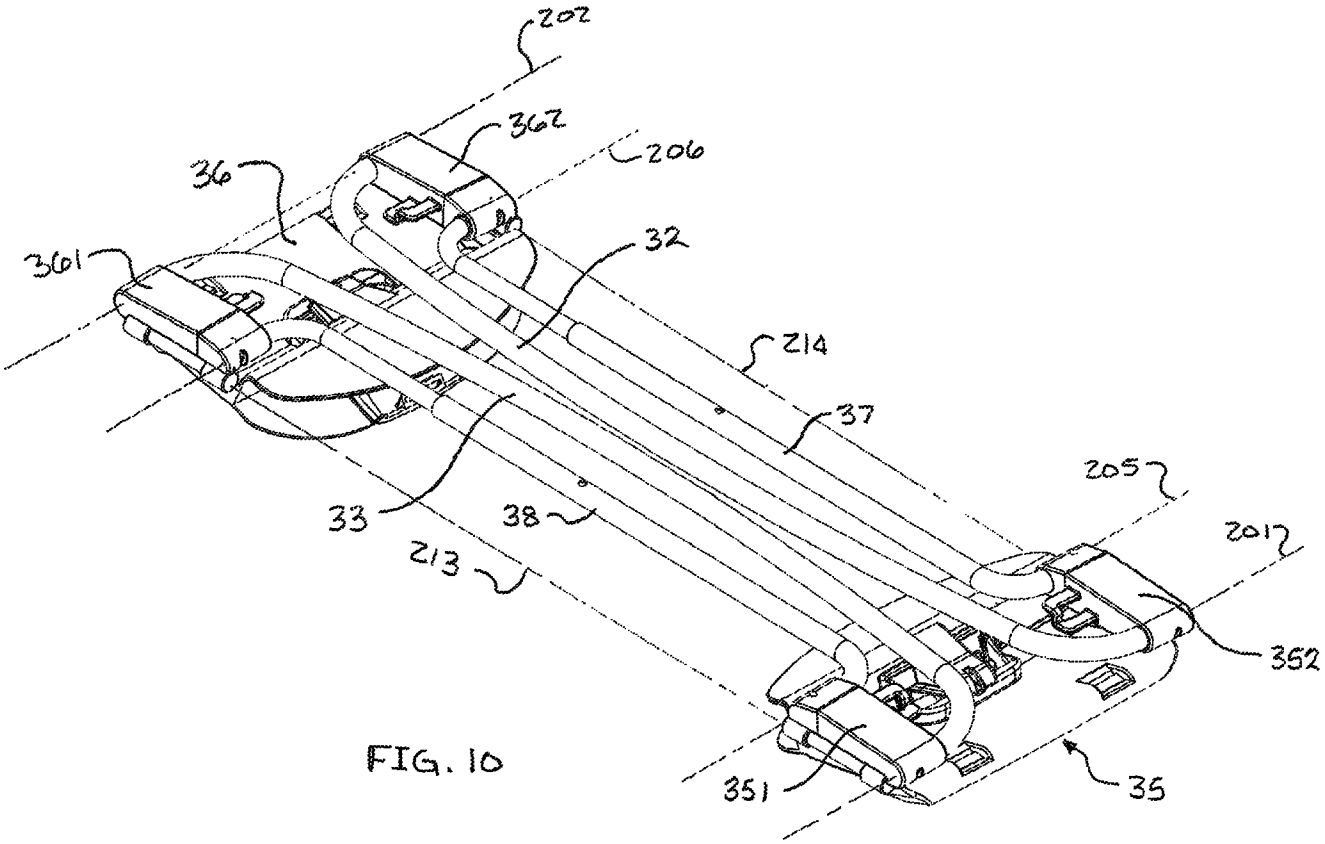
FIG. 10 is a perspective view of the accessory frame of FIG. 9 in which the wing members have been folded to allow the frame to be positioned to its minimum width.

FIGS. 8 through 10 illustrate a second embodiment of the accessory frame in which the lower frame rails 37, 38 are also rotatably connected to the outboard wing members 351, 352, 361, 362. In this embodiment, lower pivot connectors 359, 369 are relocated from the end members 35, 36 to respective outboard wing members 351, 352, 361, 362. This embodiment enables greater lateral spacing between the lower frame rails 37, 38 (wider than the width of the end members 35, 36) to improve stability of a floor panel (not shown), when installed without adversely affecting the minimum width that can be accomplished when the wing members are folded. Telescoping joints 39 are provided so that vertical collapse of the accessory frame 30 functions as previously described.

A second embodiment of the invention is presented in FIGS. 11 through 14 wherein a free-standing frame 500 is depicted. The exemplar free-standing frame 500 is configured to support a bassinet, though the frame 500 is suitable for supporting any child care accessory required to be elevated above the ground. As with the folding wing members described above, the folding free-standing frame 500 incorporates the same bi-axial folding approach requiring folding along a first axis to occur in order to align elements on a second axis thereby permitting additional folding to occur. The non-parallel nature of the respective axes also establishes a folding sequence by preventing folding movement of a subsequent step until a prior folding step is accomplished.

The free-standing frame 500 comprises first and second spaced-apart end members 514*a*, 514*b*, first and second spaced apart side frame members 512*a*, 512*b* orthogonally arranged in relation to the end frame members, and frame connectors 522*a*, 522*b*, 524*a*, 524*b* coupling the side and end frame members in a generally rectangular frame perimeter having one of the frame connectors disposed at each corner. Each end structure 514*a*, 514*b* has a first frame connector 522*a*, 522*b* connected at a first end, and a second frame connector 524*a*, 524*b* connected at an opposite end of the end member to form first and second end structures 542, 544, respectively. Respective side frame members 512*a*, 512*b* are connected at a first end to the first and second frame connectors 522*a*, 524*a* of the first end frame member 514*a*, and at a second end of each side frame member opposite of the first to the end connectors 522*b*, 524*b* disposed on the ends of the second end frame member 514*b* to form first and second side wing structures 552, 554, respectively. A corner frame connector 522 is shared between each adjacent end and side wing structure.

Figure 11:
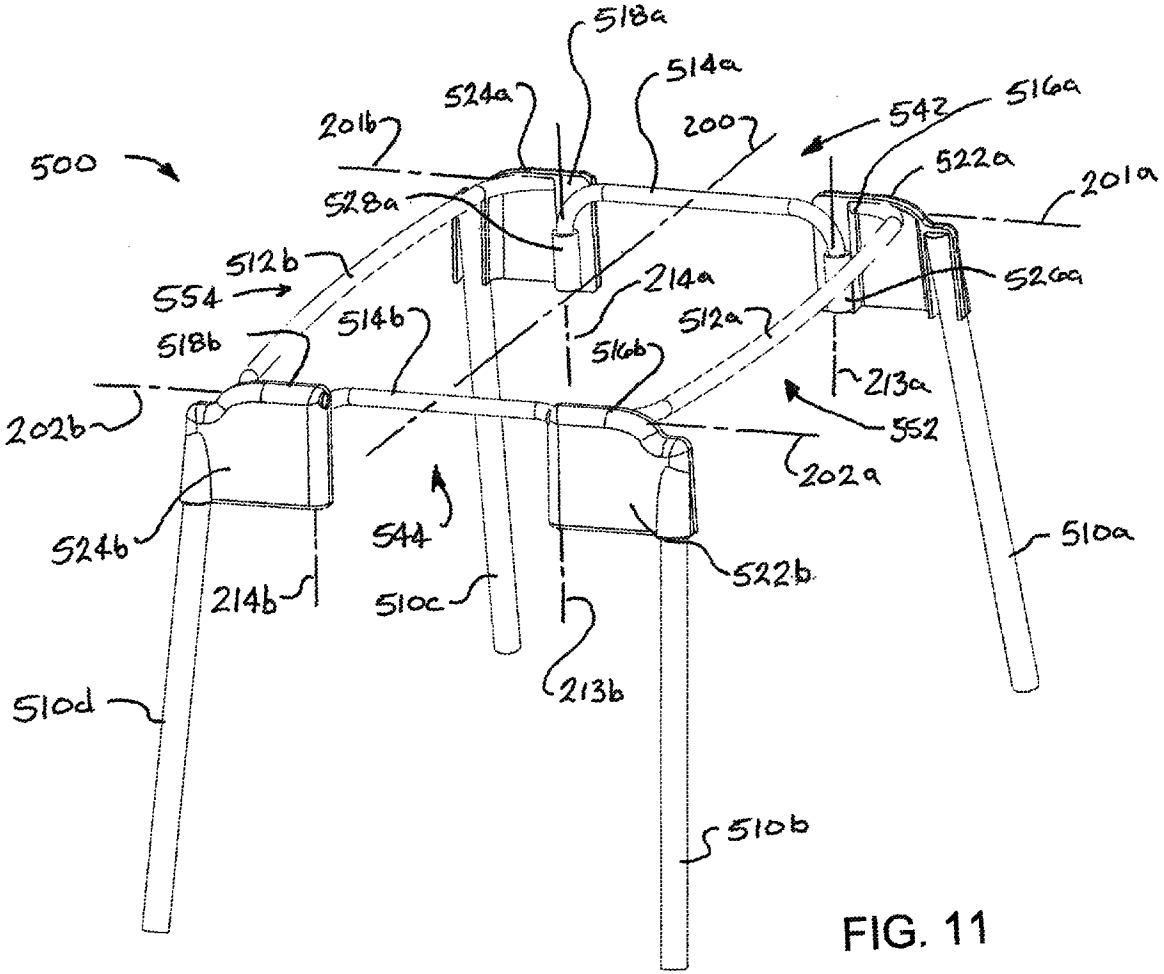
FIG. 11 is a perspective view of a free-standing frame incorporating the present invention shown in an deployed position.

The frame connectors 522*a*, 522*b*, 524*a*, 524*b* each further include a vertical support member 510*a*, 510*b*, 510*c*, 510*d* fixedly coupled thereto and extending downwardly away from the plane of the frame perimeter to support the frame perimeter at a height above the ground when the frame is in the deployed, fully unfolded position and the end structures 542, 544 are in the erected position, shown in FIG. 11. Vertical support members on opposing ends extend towards each other and into a near parallel alignment with the frame perimeter when the first and second frame connectors are pivoted about respective first and second axes 201, 202 into the folded positions.

The interface between the frame connections and first and second end frame members 514*a*, 514*b* and first and second side frame members 512*a*, 512*b* permit pivoting movement in certain frame orientations. The end pivoting interfaces 516*a*, 518*a* are arranged to permit the first end structure 542 to pivot between generally opposing folded and erected positions about a first pivot axis 201 that is arranged generally adjacently parallel to the first end member 514*a* and transverse to the longitudinal axis 200 of the frame. Similarly, pivoting interfaces 516*b*, 518*b* enables second end structure 544 to pivot between generally opposing folded and erected positions about a second pivot axis 202 that is arranged generally adjacently parallel to the second end member 214*b* and also transverse to the longitudinal axis 200. End structure pivoting may be performed independently as the respective end pivoting interfaces are not linked or otherwise connected to synchronize movement thereof.

Folding along the first and second pivot axes 201, 202 is accomplished by the pivoting interfaces 516, 518 between the first and second side frame members 512*a*, 512*b* and the frame connectors at the opposing ends of each of the side frame members. First and second side frame members 512 are aligned generally parallel to the longitudinal axis 200 and connected at respective first ends to frame connectors 522, 524 to form side wing structures 552, 554.

The end members pivot approximately 90 degrees in opposite directions to reorient the vertical support members 510 from a generally downward position to one that is generally parallel to the plane of the frame perimeter with the vertical support members extending generally toward the opposite frame end. The vertical supports may be outwardly canted or angled from the ends of the frame to provide improved stability. End member pivoting more than 90 degrees may be necessary to move the outwardly angled vertical supports into a folded position. Furthermore, it may be impossible to bring the vertical supports into precise parallel alignment with the plane of the frame perimeter thereby limiting the degree of end member pivoting permissible. As such, approximately 90 degrees encompasses a range of approximately plus/minus 15 degrees around the 90 degree pivot described.

The connection between first and second end members 514 and respective end connectors 522, 524 permits pivoting movement of the side wing members in certain orientations of the frame. First end member 514*a* connects to first frame connector 522*a* and the second frame connector 524*a* at pivoting connections that permit pivoting movement about wing axes 213*a*, 214*a*, respectively. Second end member 514*b* connects to third frame connector 522*b* and the fourth frame connector 524*b* at pivoting connections that permit pivoting movement about wing axes 213*b*, 214*b*, respectively. The wing axes are generally upstanding when the frame 500 is unfolded for use, as shown in FIG. 11, and as a consequence pivoting of the side wing structures 552, 554 is not permissible.

Figure 12:
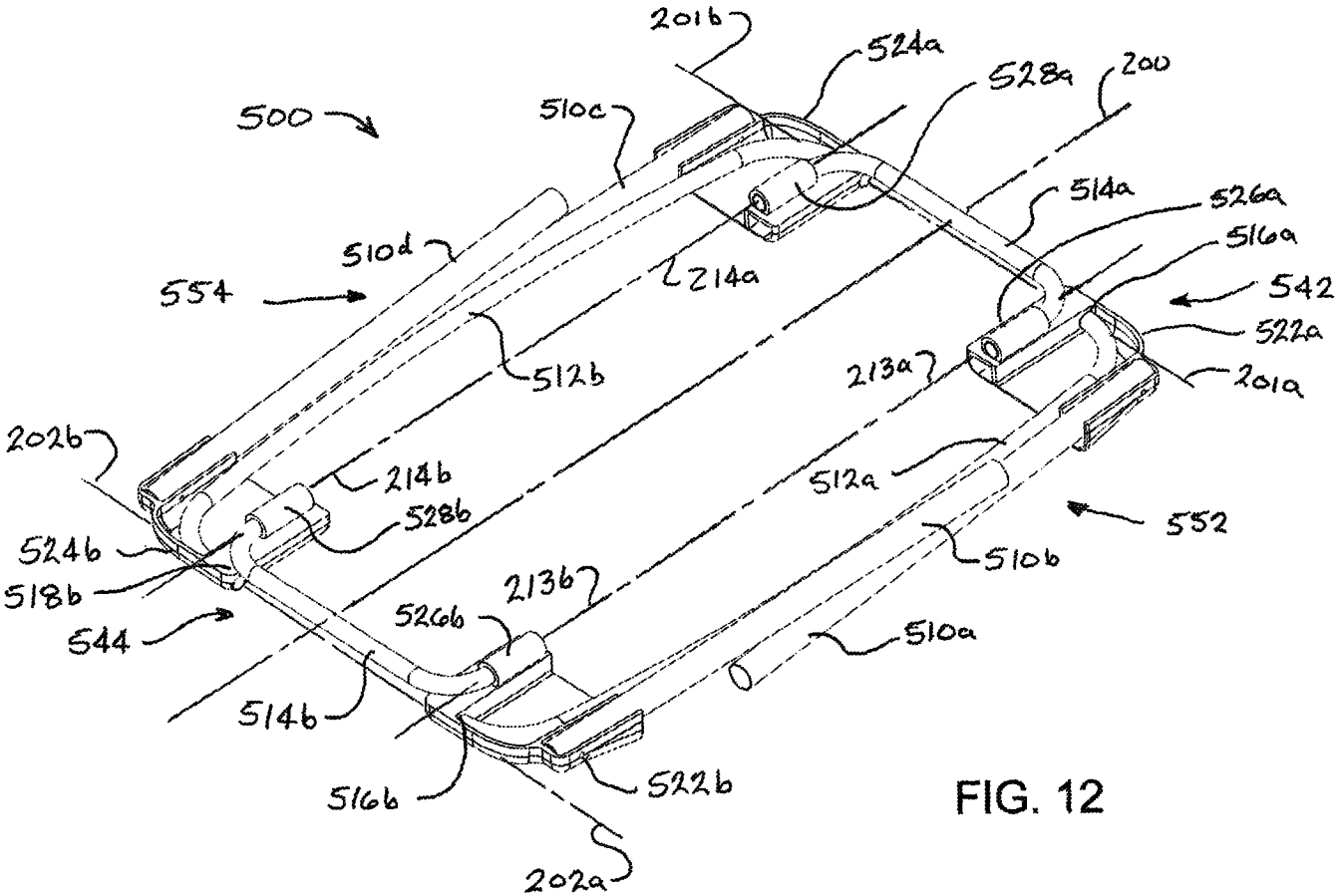
FIG. 12 is a perspective view of the free-standing frame of FIG. 11, shown in a partially collapsed position.
Figure 13:
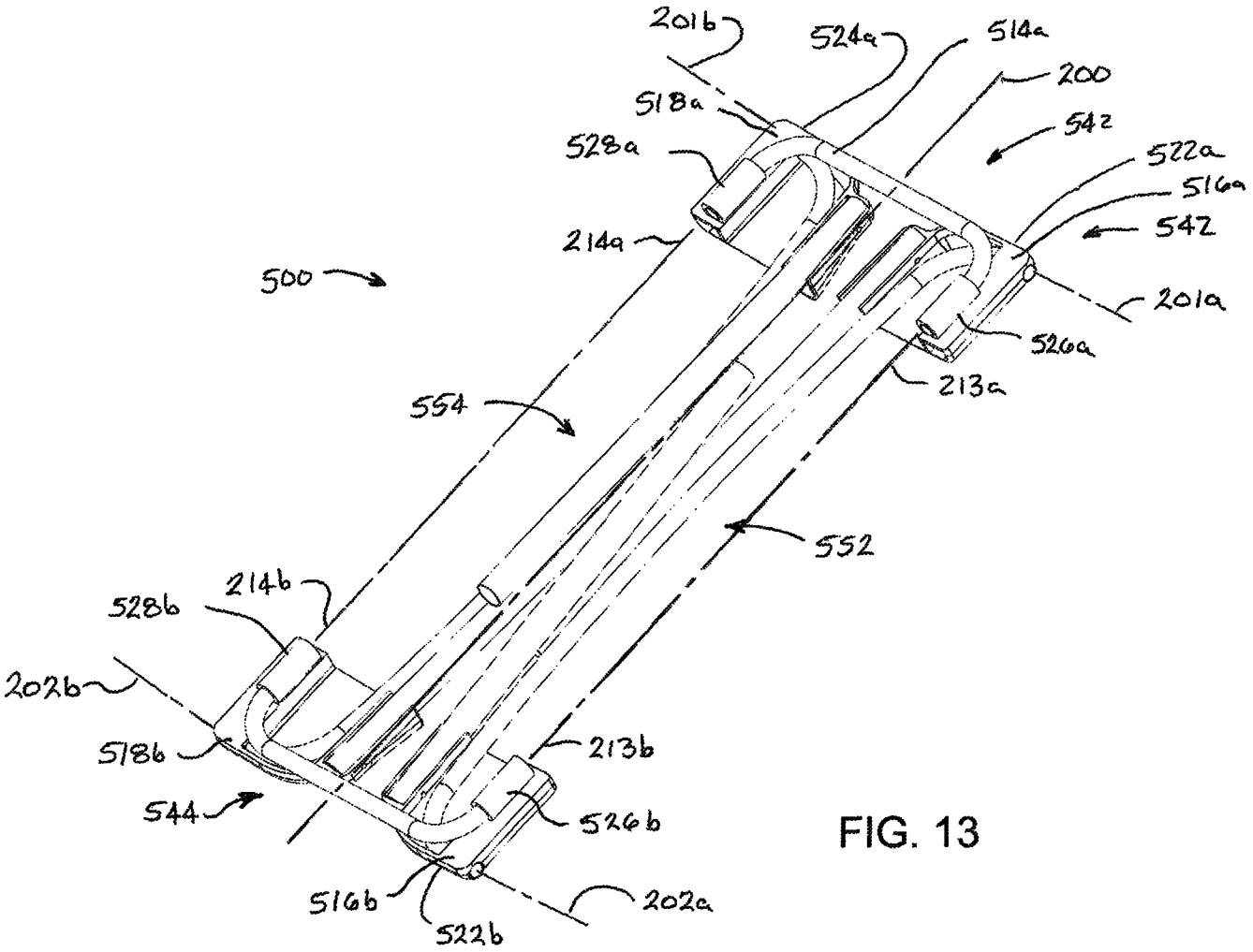
FIG. 13 is a perspective view of the free-standing frame of FIG. 11, shown in a fully collapsed position.
Figure 14:
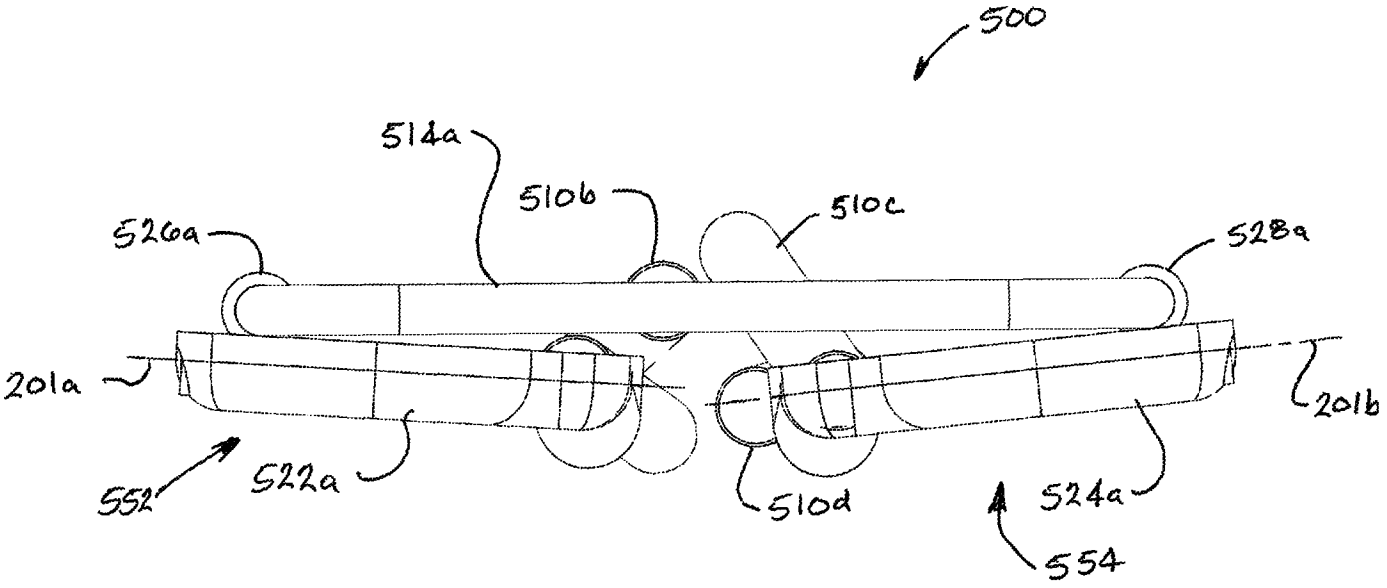
FIG. 14 is an end view of the frame as shown in FIG. 13.

As the end structures 542, 552 are moved from the erected position into the folded position, shown in FIG. 12, the first side wing axes 213*a*, 213*b* are reoriented into alignment on a shared axis 213. The second side wing axes 214*a*, 214*b* are also realigned into alignment on a shared axis 214. Once the first and second side wing axes are aligned, the side wing structures 552, 554 may be pivoted about the side wing axes 213, 214 to reduce the overall width of the frame. The side wing structures 552, 554 may be independently moved between extended (FIG. 12) and retracted (FIG. 13) positions. As with the end structures 542, 544, no link or mechanism is provided to synchronize movement of the wing structures. It is important to note that neither wing structure may be pivoted from the extended position unless both the first and second end structures 542, 544 are first moved into the folded position.

In order to prevent unintentional movement about the first and second pivot axes 201, 202, folding of the side wing structures does not result in a realignment of the first axis portions 201*a*, 201*b* nor the second axis portions 202*a*, 202*b*. In the embodiment shown, the side wing structures are pivotable slightly less than 180 degrees between the extended position (as for use of the frame) and the retracted position, shown in FIG. 12, for storage of the frame. By preventing exactly 180 degrees of side wing pivoting, folding the wings precludes alignment of the first and second pivot axes 201*a*, 201*b*, 202*a*, 202*b* and thereby inhibits unfolding movement of the end structures 542, 544 when the side wing structures 552, 554 are in the retracted position.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A collapsible frame for supporting a child supporting structure above a surface, the frame being moveable between a deployed position for use and a collapsed position for storage, the frame comprising:

generally parallel and spaced apart first and second elongate end structures transverse to a longitudinal axis, each end structure having a frame connector disposed at each end; and spaced apart right and left side frame members arranged generally parallel to the longitudinal axis and connected at each end to one of the frame connectors of the first and second end structures, respectively, to define a generally planar rectangular frame perimeter;

the frame connectors further comprising first and second end pivoting mechanisms enabling pivoting of the first and second end structures about first and second end pivot axes between an erected position and a folded position, the first and second end pivot axes being transversely aligned to the longitudinal axis; and right and left side wing folding mechanisms enabling pivoting of the right and left side wing structures, each side wing folding mechanism having a first wing pivot disposed at one end of the wing structure and a second wing pivot disposed at an opposite end of the wing structure, the first wing pivot and the second wing pivots each having wing pivot axes that are coaxially aligned when the first and second end structures are in the folded position thereby allowing pivoting of the first and second side wing structures, the first wing pivot and the second wing pivot being non-coaxially aligned when the first and second end structures are not in the folded position thereby preventing pivoting movement of the side wing structures.

2. The collapsible frame of claim 1, wherein the axes of the first wing pivot and the second wing pivot are coaxially aligned on a wing axis parallel to the longitudinal axis when the first and second end structures are in the folded position.

3. The collapsible frame of claim 2, wherein the right and left side wing folding mechanisms enable pivoting movement of the right and left side wing structures between extended and retracted positions when the first and second end structures are in the folded position, the extended position maximizing transverse width between the side rails and the retracted position minimizing transverse width between the side rails.

4. The collapsible frame of claim 3, wherein the first and second end pivoting mechanisms each have a first end pivot and the second end pivot, one end pivot disposed on respective frame connectors at opposing ends of the respective end members, the first and second end pivots having axes coaxially aligned when the right and left side wing structures are in the extended position, the first and second end pivots having axes that are non-coaxially aligned when the right and left side wing structures are in the retracted position.

5. The collapsible frame of claim 4, wherein pivoting movement of the first and second end pivoting mechanisms between the erected and the folded positions ranges from 75 to 105 degrees.

6. The collapsible frame of claim 4, wherein pivoting movement of the right and left side wing folding mechanisms between the first extended and the retracted positions is less than 180 degrees.

7. The collapsible frame of claim 1, further comprising a plurality of support legs, one support leg affixed to each frame connector and extending downwardly from the plane of the frame perimeter.

8. The collapsible frame of claim 7, wherein the plurality of support legs extending downwardly from the plane of the frame perimeter when the first and second end structures are in the erected position and are moved toward alignment with the plane of the frame perimeter when the first and second end structures are in the folded position.

9. A collapsible basinet frame for supporting a child elevated above a surface, the frame comprising:

a pair of generally parallel and spaced apart longitudinally oriented side frame members;

first and second generally parallel and spaced apart laterally oriented end frame members; and a plurality of frame connectors, each connector moveably attached to an end of one side frame member and an end of one end frame member to form a generally planar frame perimeter, each connector having a support leg affixed thereto and extending away from the plane of the frame perimeter, the plurality of frame connectors further arranged in a first pair having one frame connector disposed at opposing ends of the first frame member and a second pair having one frame connector disposed at opposing ends of the second end frame member, the first and second pairs of frame connectors configured to enable the respective attached support legs to swing about respective first and second end pivot axes toward a folded position in which the support legs are generally parallel to and adjacent to the planar frame perimeter, the frame connectors further configured to enable each side frame member to swing about a respective wing axis that is generally orthogonal to the end pivot axes between generally opposing expanded and collapsed positions, the wing axes of the first and second pairs of frame connectors being aligned only when the support legs are in the folded position.

10. The basinet frame of claim 9, wherein the side frame members are inhibited from movement unless the support legs are in the folded position.

11. The bassinet frame of claim 10, wherein the folding the side frame members about the respective wing axes reduces the width of the bassinet frame by up to one half.

* * * * *